US005239346A

United States Patent [19]

Corbin et al.

[11] Patent Number: 5,239,346

[45] Date of Patent: Aug. 24, 1993

[54] AGITATOR FOR TONER SUPPLY SYSTEM HAVING CLEANING ATTACHMENT

[75] Inventors: Robert W. Corbin, Fairport; William E. Detwiler, Webster; Teresa A. Kime, Rochester, all of N.Y.

[73] Assignee: Xerox Corporation, Stamford, Conn.

[21] Appl. No.: 919,330

[22] Filed: Jul. 27, 1992

[51] Int. Cl.[5] ..... G03G 15/06

[52] U.S. Cl. ..... 355/260; 118/612; 118/653; 355/245

[58] Field of Search ..... 355/245, 260, 200, 246; 118/653, 658, 612; 366/142, 154, 155, 342, 343; 241/98

[56] References Cited

U.S. PATENT DOCUMENTS

| | | | |
|---|---|---|---|
| 4,660,505 | 4/1987 | Goto et al. | 118/658 X |
| 4,956,669 | 9/1990 | Nakamura | 355/246 X |
| 4,963,929 | 10/1990 | Ueda et al. | 355/246 X |

*Primary Examiner*—A. T. Grimley
*Assistant Examiner*—Sandra L. Brasé
*Attorney, Agent, or Firm*—R. Hutter

[57] ABSTRACT

An agitator for agitating particles such as toner particles in an electrophotographic printer includes a stirring member having an elongated longitudinal member. Vanes are attached to the longitudinal member and form a gap therebetween. When the longitudinal member is caused to move within a cavity, the vanes act to clear toner particles from an area within the cavity associated with a sensor.

7 Claims, 3 Drawing Sheets

AGITATOR FOR TONER SUPPLY SYSTEM HAVING CLEANING ATTACHMENT

The present invention relates to an agitator for use in a toner supply dispenser as used in, for example, a xerographic copier or printer. More specifically, the present invention relates to such an agitator which is suitable for clearing a zone around a sensor associated with a toner container.

In electrophotographic applications such as xerography, a charge retentive surface is electrostatically charged, and then exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals, where a charged surface may be imagewise discharged in a variety of ways.

Developing material commonly used in systems for developing latent images on the charge retentive surface typically comprises a mixture of toner and a "carrier" of larger granular beads of a ferrous material. If the developing system includes a magnetic brush assembly, magnetizable carrier beads also provide mechanical control for the formation of magnetic brush bristles so that toner can readily be brought into contact with the charge retentive surface. Toner is attracted to the latent image from the carrier beads to form the toner image.

In certain types of electrophotographic printers, particularly those of the "high-volume" or "mid-volume" variety, it is common to provide an external supply of pure toner, which is gradually introduced into the toner-carrier mixture forming the developer as toner is depleted from the toner-carrier mixture in the course of use. This pure toner supply is typically in the form of a separately-purchasable toner bottle. A typical size of a toner bottle in commercial use is a bottle of approximately 5 pounds of toner, typically having a volume of between 1 and 2 gallons. When handled in bulk, toner particles require careful flow control in order to avoid problems such as leakage, clumping, or clogging of the toner supply. Ordinarily, toner comprises very fine particles in combination with a flow agent, and thus flows readily from even the smallest cracks in a toner supply system. Simultaneously, various temperature and humidity conditions may cause toner particles to "clump," or agglomerate, within a toner supply, thus disturbing the desired constant flow of toner into a system. Such agglomerated toner may then clog, or "bridge," between internal surfaces of a toner dispensing system.

In a large system, it is desirable to know whether there is an appreciable quantity of toner present at any given point along the toner supply and dispensing system. For detecting the presence of toner in a certain location, various types of sensors are well-known in the prior art. For example, optical sensors, in which the opacity or light-absorptive qualities of toner are exploited, are known, as are magnetic detectors which are useful in those systems wherein the toner is designed to have a magnetic property associated therewith. Another type of toner sensor which has recently found favor is the vibrational sensor. In such a sensor, a vibrating member, typically made of a ceramic material having an electrode structure therein, is caused to vibrate at a certain frequency while a certain portion of the member is in contact with toner particles. The vibrational characteristics of the member will vary depending on whether the vibrating member is in contact with an appreciable amount of toner particles. When there are very few toner particles in contact with the vibrating member, such as when the particular location is substantially empty of toner particles, the vibrating member will assume a characteristic vibrational behavior, different from that in the case where the member is vibrating against a mass of toner particles. These changes in characteristics may be detected electronically, and may be used to control the system or indicate to the user that, for example, the external toner supply bottle is empty. One type of vibrational sensor, made by Motorola, Inc., of Albuquerque, N. Mex., comprises a sandwiched ceramic piezoelectric member, generally forming a plane approximately 1 centimeter square, which forms a "fin" which is intended to extend into a cavity of a container for toner particles. When the cavity is full of toner particles and the fin is thus substantially in contact with toner particles, the fin will vibrate in one detectable way (such as at one frequency), and when the container is empty of toner particles, the fin will be caused to vibrate in another detectable way (such as at another frequency).

When using such a vibrational detector that forms a fin extending into the toner supply path, a crucial concern if the detector is to operate properly is to avoid the "bridging" or agglomeration of toner particles around the fin. For example, when toner particles have substantially emptied out of a cavity in the course of use of the system, the fin should ideally be contacting very few remaining particles in the container, and thus should be vibrating with a characteristic that would be detected and interpreted as showing an empty container. However, it is possible that a quantity of toner will have agglomerated around the fin itself, causing the fin to remain in substantial contact with toner particles even as the container itself is substantially empty of particles. In such a case, the fin will be vibrating as though the container is full of particles when the particles are only clumped around the fin, and the toner-empty condition will not be detected.

Certain products currently commercially available which include this type of vibrational detector are the Xerox Corporation Models No. 5100, as well as certain of the models No. 4850 or "DocuTech" (a trademark of Xerox Corporation). Disclosures of the toner dispenser systems as substantially used in these models are shown, for example, in the Xerox Disclosure Journal, Vol. 16, No. 2, March/April 1991, Page 121; Vol. 17, No. 3, May/June 1992, Page 149; and Vol. 14, No. 6, November/December 1989, Page 305. As shown particularly in the March/April 1991 Disclosure, a common configuration is to have a toner bottle oriented neck-down so that toner will pour by gravity into a trough which narrows toward a slot which opens onto a rotating auger which in turn is used to distribute toner particles along a length of a developer housing, as is known in the art. An important location for determining the presence or absence of toner is in this trough into which the toner supply bottle discharges toner. Once this trough becomes empty of toner, the system should indicate to the user that the toner supply bottle should be replaced. This trough, then, is thus an important location for a toner sensor such as a vibrational sensor, and thus it is crucial to avoid toner agglomeration in this trough. The above-mentioned Xerox Corporation products employ a reciprocating agitator within this trough to maintain a consistency to the toner particles as the toner particles negotiate the narrowing path from the toner supply bottle through the slot to the auger, but it has been found that the avoidance of agglomeration around the sensor, particularly a fin-type vibrational sensor, is still crucial.

According to one aspect of the present invention, there is provided an agitator for agitating particles, comprising a stirring member, with means for attachment to a source of motion to cause the stirring member to move through a direction of motion. Vanes are attached to the stirring member, defining primary surfaces which are substantially oblique relative to the direction of motion, and defining a gap between them along the direction of motion.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
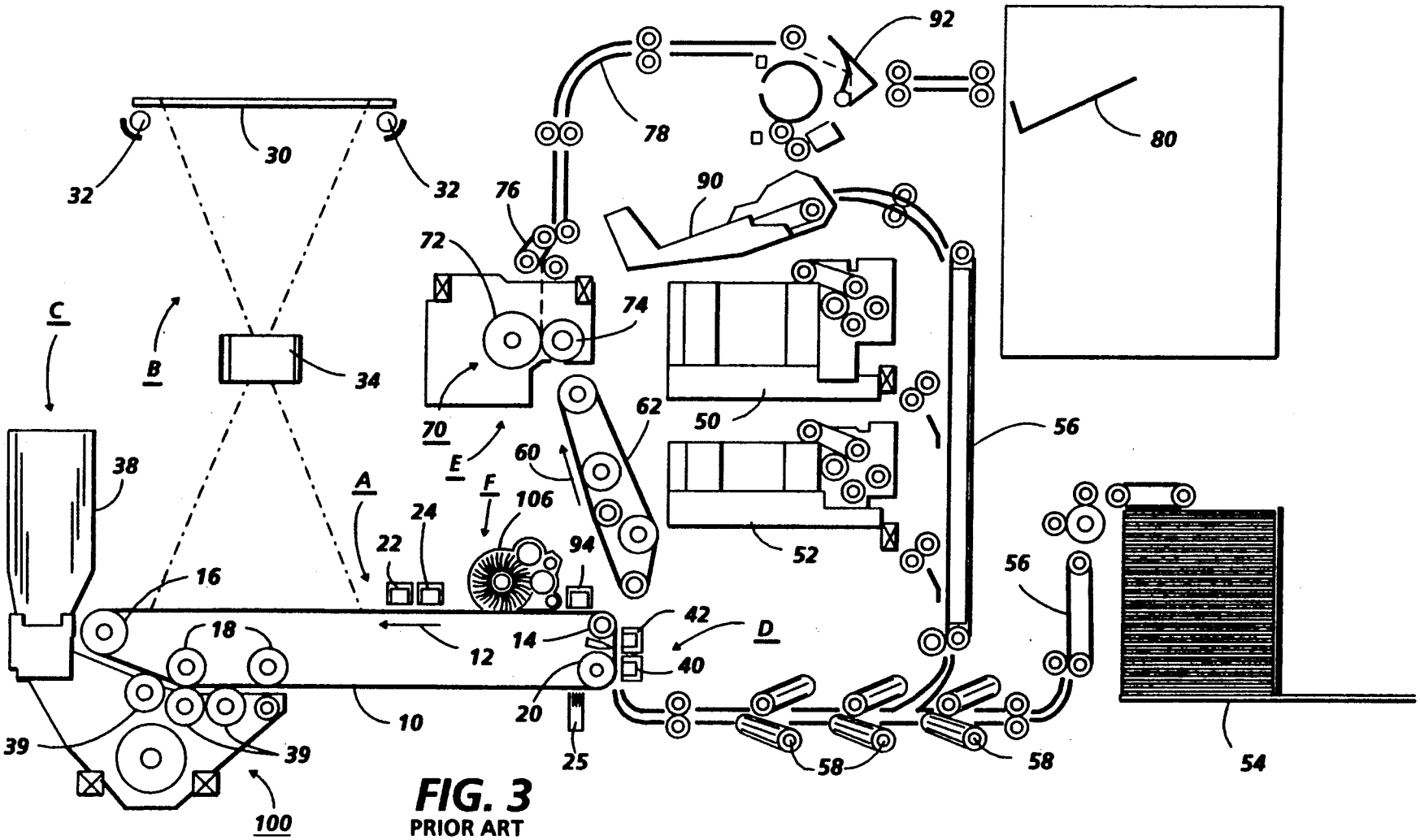
FIG. 3 PRIOR ART
FIG. 3 is a simplified elevational view showing the primary components of a typical commercially available electrophotographic printer.

Referring now to the drawings, for the purpose of describing a preferred embodiment of the invention and not for limiting same, the various processing stations employed in the reproduction machine illustrated in FIG. 3 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Photoreceptor belt 10 is entrained about stripping roller 14, tension roller 16, idler rollers 18, and drive roller 20. Drive roller 20 is coupled to a motor (not shown) by suitable means such as a belt drive.

Photoreceptor belt 10 is maintained in tension by a pair of springs (not shown) resiliently urging tension roller 16 against belt 10 with the desired spring force. Both idler rollers 18 and tension roller 16 are rotatably mounted. These rollers are idlers which rotate freely as belt 10 moves in the direction of arrow 12. Belt 10, in combination with stripping roller 14, tension roller 16, idler rollers 18, and drive roller 20, forms a "photoreceptor assembly" which, in a typical commercially made copier, may be formed on a pivoting assembly for convenience in servicing.

Figure 1:
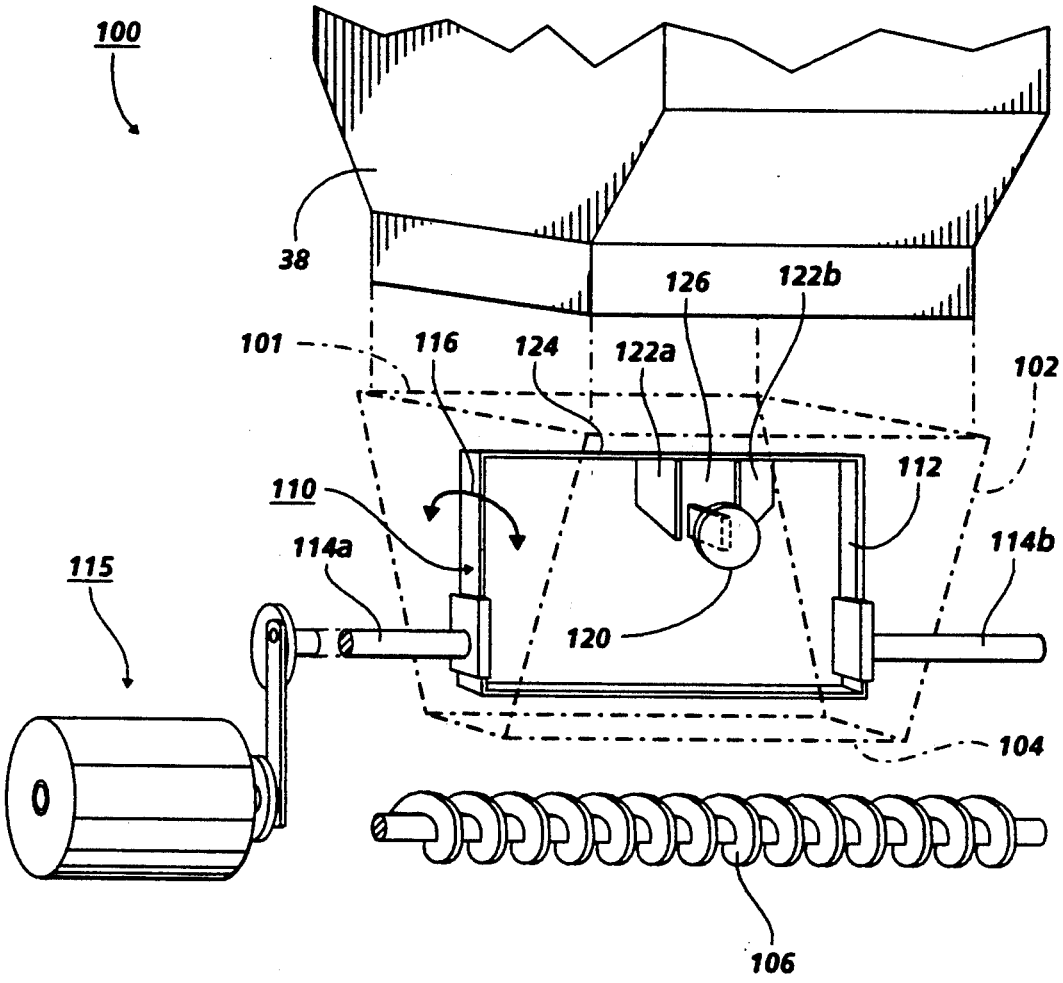
FIG. 1 is an elevational view of a portion of a developer unit as would be used in an electrophotographic printer such as that shown in FIG. 3.

With continued reference to FIG. 1, initially a portion of belt 10 passes through charging station A. At charging station A, a pair of corona devices 22 and 24 charge photoreceptor belt 10 to a relatively high, substantially uniform negative potential. The edge of the photoreceptor belt 10 is typically grounded by a ground brush 25, which is used as part of a "closed-loop" charging system.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, photoreceptor belt 10 advances the electrostatic latent image to development station C. At development station C, a magnetic brush developer unit generally indicated as 100 advances a developer mix (i.e. toner and carrier particles, also known as carrier beads) into contact with the electrostatic latent image with magnetic brushes 39. Pure toner to be gradually introduced into the toner-carrier mix forming the developer mix is stored in a toner bottle 38, which is typically in the form of a 1-2 gallon plastic bottle which is inverted to discharge pure toner into the developer unit 100 as needed. The latent image attracts toner particles from the carrier granules, thereby forming toner powder images on photoreceptor belt 10.

Photoreceptor belt 10 then advances the developed latent image to transfer station D. At transfer station D, a sheet of support material such as paper copy sheet is moved into contact with the developed latent images on belt 10. First, the latent image on belt 10 is exposed to a pre-transfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet from belt 10, whereupon the sheet is stripped from belt 10 at stripping roller 14.

Sheets of substrate or support material are advanced to transfer station D from supply trays 50, 52 and 54, which may hold different quantities, sizes and types of support materials. Sheets are advanced to transfer station D along conveyors 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc., and removal from the machine by the operator. Alternatively, the sheet may be advanced to a duplex tray 90 from duplex gate 92 from which it will be returned to the processor and conveyor 56 for receiving second side copy.

A pre-clean corona generating device 94 may be provided for exposing the residual toner and contaminants to positive charges to thereby narrow the charge distribution thereon for more effective removal at rotating electrostatic brush cleaning station F.

As thus described, a reproduction machine in accordance with the present invention may be any of several well known devices. Variations may be expected in specific electrophotographic processing, paper handling and control arrangements without affecting the present invention.

FIG. 1 is a detailed view of the location of developer unit 100 where toner bottle 38, which is inverted to be neck-down, causes toner to be discharged into developer unit 100. Such an arrangement is seen, for example, in the Xerox Corporation Models mentioned above. The inverted bottle 38 opens into a trough 102 which has a relatively wide substantially rectangular opening at its top 101 and gradually narrowing to an elongated slot 104, so that trough 102 generally forms a funnel. In the Figure, trough 102 is shown in phantom to indicate that it is in the form of a cavity defined by the structure of the developer unit 100. Although in the embodiment shown, the relevant cavity for purposes of describing the present invention is a trough which accepts toner from an external container, it would be apparent to one skilled in the art that the present invention is applicable to any cavity for holding or conveying toner particles or any other type of particles, in which a sensor of any kind is employed.

At the bottom of slot 104 is, in this embodiment, a rotating auger 106. Such augers are well known in the art of developer units, and function to distribute incoming toner laterally across a developer housing, so that the developer mix will not be caused to concentrate on one portion of the developer housing at the expense of another. The developer mix in the developer unit is "picked up" by, for example, a magnetic developer roll for conveyance to the latent image on the photoreceptor, as is well known in the art of xerography. Slot 104 in this embodiment, then, is preferably narrow and elongated so as to deposit toner onto the auger 106 for proper lateral distribution of toner.

Disposed within the trough 102 is an agitator generally indicated as 110. In the preferred embodiment, agitator 110 includes a stirring member in the form of a frame 112, which is preferably, but not necessarily, in the form of an enclosed, substantially rectangular loop of stainless steel. The stirring member is attached by means of axles 114*a* and 114*b* to an external source of reciprocal motion, such as the motor and crack mechanism indicated generally as 115, which will cause the frame 112 to reciprocate within the cavity of trough 102. Preferably, axles 114*a* and 114*b* are placed off-center relative to the body of frame 112 so that, when a reciprocating motion is applied to one or both of the axles 114*a* or 114*b*, frame 112 will move through a path as indicated by double-headed arrow 116 in order to encompass the bulk of the internal volume of trough 102. Thus, frame 112 of agitator 110 is adapted to pivot back and forth by the axles 114*a* and 114*b* through the interior of trough 102.

Disposed on an internal surface of trough 102 is a sensor adapted to detect the presence or absence of toner particles within trough 102. If the trough 102 is empty of toner particles, this is usually an indication that the external toner supply in toner bottle 38 is empty and should be replaced by the user. Various types of sensors may be employed for this purpose with varying degrees of efficacy, such as optical, infrared, or vibrational sensors. One preferred type of sensor is a vibrational sensor such as that manufactured by Motorola, in which a substantially flat ceramic member is caused by electrical means to vibrate, the vibrational response of the vibrating member being variable depending whether the member is in contact with a significant amount of toner particles. In a preferred type of vibrational sensor, the ceramic vibrating member is in the form of a flat fin, typically of a dimension of approximately one centimeter square, which extends into the interior of trough 102. Such a fin, and its attendant support structure, is shown as sensor 120 in FIG. 3. The flat fin is supported on one edge and extends into the interior of the cavity formed by trough 102. In order to function properly, toner agglomerations must be removed from the area around sensor 120 so that the sensor will be able to detect a true toner-empty situation.

In order to maintain the zone around the fin of sensor 120 clear of toner when the trough 102 is in fact substantially empty of toner, the present invention provides two vanes shown as 122*a* and 122*b*, which are preferably mounted on a longitudinal member 124 which forms part of the frame 112 of agitator 110. Vanes 122*a* and 122*b* are generally planar and define primary surfaces which are substantially oblique relative to the direction of motion 116 of agitator 110. Longitudinal member 124 is disposed parallel to, but spaced from, the axis about which agitator 110 rotates, and the vanes 122*a* and 122*b* are disposed generally between the longitudinal member 124 and the axis. Vanes 122*a* and 122*b* are preferably symmetrical to each other. As agitator 110 is moved back and forth through the interior of the cavity of the trough 102, the vanes 122*a* and 122*b* will in effect "plow away" any agglomerated toner around the fin of sensor 120. The oblique orientations of the vanes 122*a* and 122*b* serve to displace agglomerated toner from the area around the fin of sensor 120 as the vanes move back and forth relative to the fin when agitator 110 reciprocates.

In order not to damage the fin of sensor 120, there is provided a gap 126 between the two vanes 122*a* and 122*b* which will accommodate the fin of sensor 120 so that the fin is spaced from vanes 122*a* or 122*b*. Gap 126 should be aligned with the direction of motion as the agitator 110 moves in the direction of arrow 116, so that objects, such as the fin of sensor 120, may be placed within the "path" formed by the sweep of gap 126. In order to provide effective plowing of agglomerated toner from the area around the fin, a useful width of the gap 126 between vanes 122*a* and 122*b* should leave a spacing of between 1 millimeter and 5 millimeters on either side of the fin 120. This tolerance will both allow proper cleaning of the area around the fin, while providing a substantial tolerance to ensure that the vanes or any other part of the agitator 112 will not touch the relatively brittle and fragile fin of sensor 120. The vanes 122*a* and 122*b* serve to clear toner from the area around the fin, regardless of whether the trough 102 is at the moment full or empty of toner particles, as the agitator 110 as a whole serves to agitate the toner particles generally for efficient flowing of toner through the system.

Figure 2:
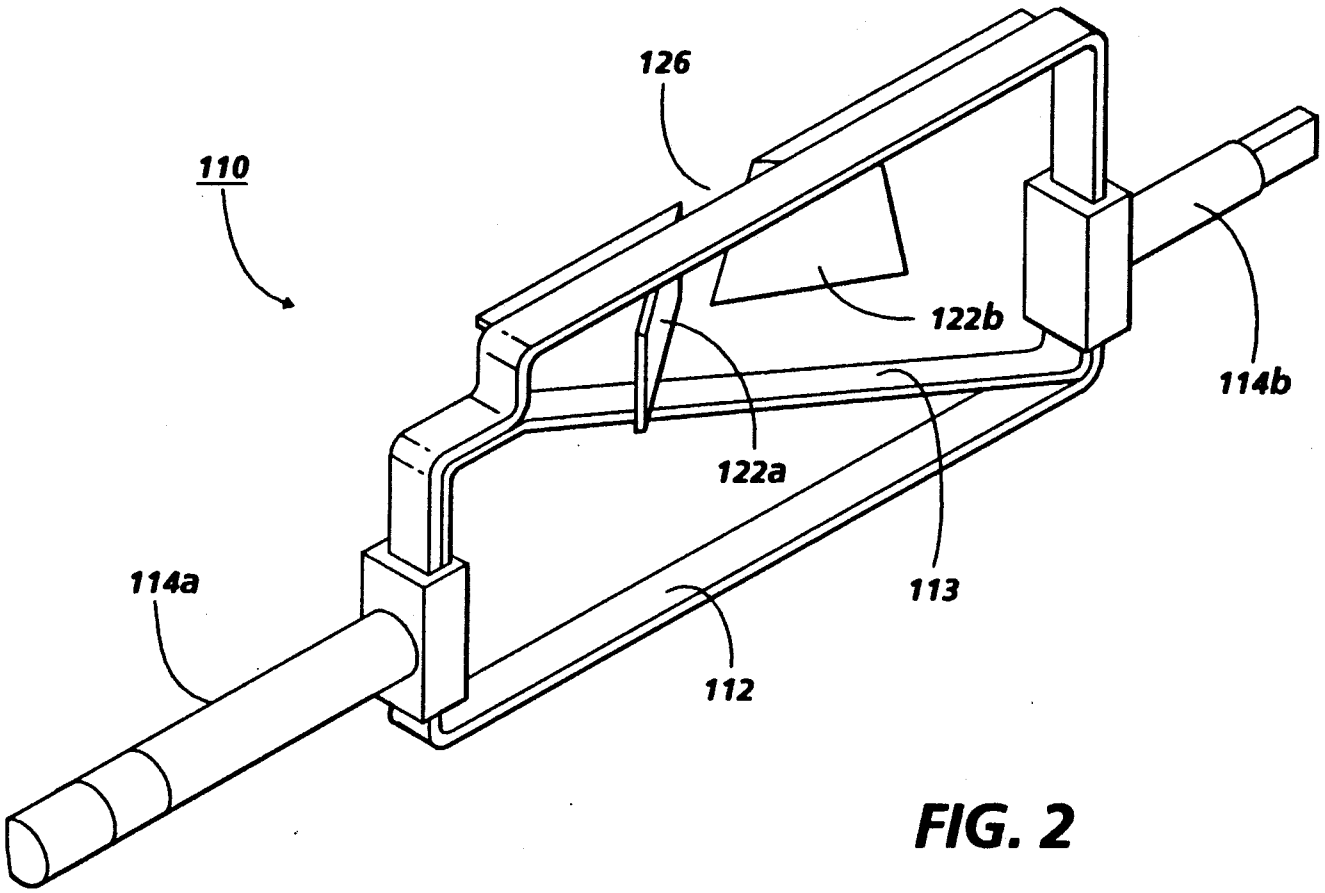
FIG. 2 is an elevational view of an agitator incorporating the present invention, shown in isolation.

FIG. 2 shows an adaptation of agitator 110, employing the present invention, in isolation. In addition to the enclosed loop 112, the agitator 110 may include additional cross bars such as 113, as shown. The vanes 122*a* and 122*b* of the present invention may be placed on a preexisting agitator 110 by means of clips as part of an after-market retrofit. The preferred material for agitator 110 as well as the vanes 122*a* and 122*b* is stainless steel.

It is to be understood that, although the agitator of the present invention is particularly effective in clearing agglomerated toner from a fin-type vibrational sensor, an agitator according to the present invention may also be useful for clearing agglomerated toner from other types of sensor as well, such as a vibrational sensor having a surface substantially parallel to the inner surface of the cavity, or any type of magnetic or optical sensor. For just about any commonly used type of toner sensor, an agglomeration of toner on or near the sensor will tend to cause misleading or inaccurate readings from the sensor, and therefore an agitator according to the present invention will be useful in all of these situations.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An agitator for agitating particles, comprising:

a stirring member;

means for moving the stirring member through a direction of motion about an axis; and first and second vanes attached to the stirring member, defining primary surfaces which are substantially oblique relative to the direction of motion, and defining a gap therebetween, the gap being aligned with the direction of motion, wherein the stirring member comprises an elongated longitudinal member, spaced from the axis and substantially parallel to the axis with the vanes being disposed substantially between the elongated longitudinal member and the axis.

2. An agitator for agitating particles in a container defining a cavity having an inner surface, and sensor means defined at a location on the inner surface, comprising:

a stirring member;

means for moving the stirring member through a direction of motion about an axis within the cavity; and first and second vanes attached to the stirring member, the vanes being arranges substantially along a common longitude parallel to the axis, the vanes defining primary surfaces which are substantially oblique relative to the direction of motion, the first and second vanes being arranged to define a gap therebetween, the gap being generally disposed adjacent the sensor means along at least a portion of the direction of motion of the stirring member within the cavity, wherein the stirring member comprises an elongated longitudinal member, spaced from the axis and substantially parallel to the axis with the vanes being disposed substantially between the elongated longitudinal member and the axis.

3. An agitator according to claim 2, wherein the sensor means includes a fin extending into the cavity, and wherein the gap is arranged to permit the passage of the fin therethrough along at least a portion of the direction of motion of the stirring member within the cavity.

4. An agitator according to claim 3, wherein the moving means moves the stirring member in a reciprocating manner within the cavity, whereby the vanes move toward and away from the sensor means in a cyclical manner.

5. An agitator for agitating particles in a container having a sensor, comprising:

a stirring member;

means for moving the stirring member through a direction of motion;

means for displacing particles from a region adjacent the sensor as the stirring member moves through the direction of motion, the displacing means including a vane defining a primary surface which is substantially oblique relative to the direction of motion; and means for attaching the displacing means to the stirring member, the attaching means including clip means, whereby the vane is removably attachable to the stirring member.

6. An agitator according to claim 5, wherein said displacing means comprises a second vane, the firstmentioned vane and the second vane defining a gap therebetween, the gap being aligned with the direction of motion.

7. An agitator according to claim 6, wherein the firstmentioned vane and the second vane are symmetrical relative to the gap.

* * * * *